United States Patent [19]

Webb et al.

[11] 4,009,590

[45] Mar. 1, 1977

[54] SINGLE EVAPORATOR, SINGLE FAN COMBINATION REFRIGRATOR WITH INDEPENDENT TEMPERATURE CONTROLS

[75] Inventors: William M. Webb; William F. Hester, both of Louisville, Ky.

[73] Assignee: General Electric Company, Louisville, Ky.

[22] Filed: Jan. 2, 1976

[21] Appl. No.: 646,167

[52] U.S. Cl. ..... 62/180; 62/187; 62/455

[51] Int. Cl.[2] ..... F25D 17/00

[58] Field of Search ..... 62/180, 187, 455

[56] References Cited

UNITED STATES PATENTS

| | | | |
|---|---|---|---|
| 2,863,300 | 12/1958 | Murphy et al. | 62/180 |
| 3,005,321 | 10/1961 | Devery | 62/186 |
| 3,126,717 | 3/1964 | Schumacher | 62/180 |
| 3,320,761 | 5/1967 | Gelbard | 62/180 |
| 3,793,847 | 2/1974 | Scarle et al. | 62/190 |

*Primary Examiner*—William E. Wayner
*Assistant Examiner*—Robert J. Charvat
*Attorney, Agent, or Firm*—Steven C. Schnedler; Francis H. Boos

[57] ABSTRACT

A single evaporator, single fan combination refrigerator includes a temperature control system which thermostatically maintains the fresh food compartment at a desired temperature by cycling the refrigeration system on and off as required, and which controls freezer compartment temperature by varying the airflow through a duct conducting refrigerated air from the evaporator chamber to the fresh food compartment. In order to compensate for variations in freezer compartment temperature which would otherwise result when the setting of the fresh food control is changed, the airflow through the duct is varied as a funtion of the setting of the fresh food control, as well as of the freezer control.

14 Claims, 19 Drawing Figures

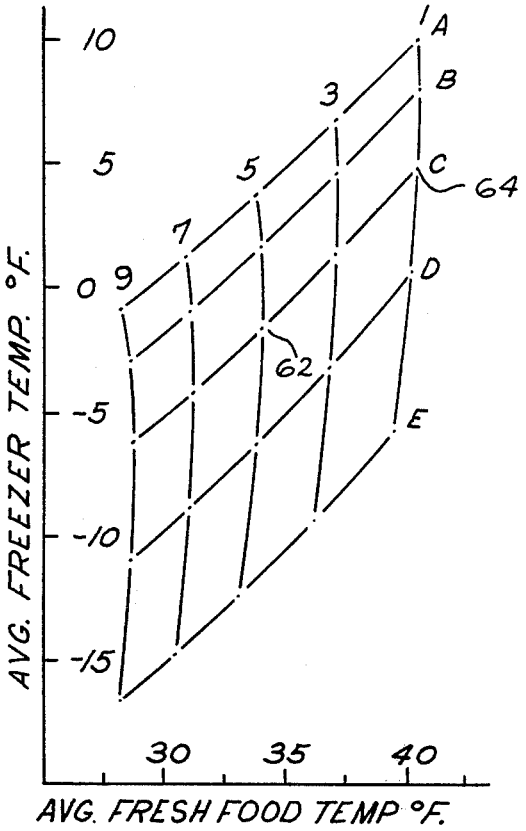
FIG. 2
PRIOR ART
FIG. 3
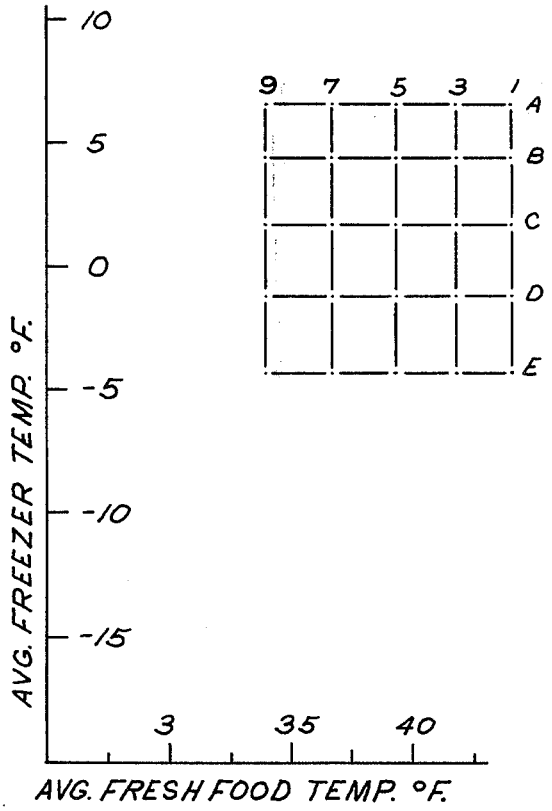

SINGLE EVAPORATOR, SINGLE FAN COMBINATION REFRIGRATOR WITH INDEPENDENT TEMPERATURE CONTROLS

BACKGROUND OF THE INVENTION

1. Field of the Invention

The present invention relates to household refrigerators and more particularly to a temperature control system for a single evaporator, single fan type combination refrigerator including independent freezer compartment and fresh food compartment temperature controls.

2. Description of the Prior Art

Combination refrigerators of the "frost free" type including a single evaporator and a single fan for circulating air from the freezer and the fresh food compartments over the evaporator are well known. Examples are disclosed in U.S. Pat. No. 3,126,717-Schumacher and in U.S. Pat. No. 3,320,761-Gelbard. In such refrigerators, refrigerated air from the evaporator is apportioned between the two compartments, with a major portion (approximately 90%) being directed through a passageway into the freezer compartment while a smaller portion (approximately 10%) is directed through a duct into the fresh food compartment. Two user-operable temperature control members are provided. One control member is for setting a temperature to be maintained in the fresh food compartment and is typically called either the "fresh food control" or "cold control." The fresh food control dial has graduations from 1 through 9, 1 indicating the warmest temperature and 9 indicating the coldest temperature to be set. The other control member is for setting a temperature to be maintained in the freezer compartment and is typically called the "freezer control." The freezer control has graduations from A through E, with E being the coldest position.

The fresh food control is operatively connected to a thermostatic control which senses either fresh food compartment air temperature or a mixture of compartment air and incoming refrigerated air from the evaporator and thermostatically maintains the fresh food compartment temperature near the desired temperature by periodically energizing and de-energizing the refrigeration compressor, and thus the evaporator, in a conventional manner. Usually, the fan is energized and de-energized along with the evaporator. The thermostatic control causes energization of the evaporator when the fresh food compartment temperature exceeds the temperature setting of the fresh food control and causes de-energization of the evaporator when the fresh food compartment temperature is less than the temperature setting of the fresh food control.

The freezer control is connected in simple fashion to an air flow damper positioned in the duct which carries refrigerated air from the evaporator chamber to the fresh food compartment. In operation, as the freezer control is moved toward E, or the coldest position, the damper is closed more, reducing the amount of refrigerated air flowing into the fresh food compartment. Since the temperature in the fresh food compartment is thermostatically controlled, the compressor, under control of the thermostatic control, simply runs longer or more often to satisfy the requirements of the fresh food compartment. When the compressor and evaporator run more, more refrigerated air flows into the freezer compartment for a longer period of time and the freezer compartment gets colder. Conversely, as the freezer control is moved toward A, or the warmest position, the damper is opened more, allowing more refrigerated air from the evaporator chamber to flow through the duct into the fresh food compartment. This causes the compressor and the evaporator to be energized less frequently or for shorter periods of time to satisfy the cooling requirements of the fresh food compartment. Since the temperature in the freezer compartment is directly related to the percentage of compressor and evaporator "on" time, the temperature in the freezer compartment decreases.

To summarize the above, in prior art refrigerators the temperature in the fresh food compartment is thermostatically controlled by energizing the compressor and evaporator in response to the cooling requirements of the fresh food compartment. Being under actual thermostatic control, the temperature is maintained quite efficiently at approximately the desired temperature. The temperature in the freezer compartment is not thermostatically controlled but rather is controlled by varying the flow of refrigerated air from the evaporator chamber to the fresh food compartment, thereby forcing the compressor and evaporator to run for either longer or shorter periods of time to satisfy the requirements of the fresh food compartment, indirectly affecting the temperature in the freezer compartment.

Temperature control systems of the above described type, while inexpensive and relatively effective, have the disadvantage that the fresh food and freezer controls do not exert truly independent control over the temperatures of the two compartments. The interaction between the temperature controls contributes significantly to customer dissatisfaction and costly complaints. In actual operation, the fresh food control, in addition to desirably setting a temperature to be thermostatically maintained in the fresh food compartment, undesirably affects the temperature of the freezer compartment. This undesirable effect is a direct result of the fact that as the setting of the fresh food control is varied, in order to satisfy the cooling requirements of the fresh food compartment as determined by the fresh food control setting, the percentage of compressor and evaporator run time also varies. For example, if the compressor runs longer to maintain the fresh food compartment at a lower desired temperature, the freezer temperature is also lowered. The freezer control actually operates as a temperature differential control to maintain the freezer compartment temperature at a given temperature below the fresh food compartment temperature, the given temperature being determined by the setting of the freezer control. If the fresh food control setting is not disturbed, then the freezer control actually does control the temperature in the freezer. However, if the fresh food control setting is changed, with no change in the freezer control setting, the temperature differential between the two compartments is approximately maintained and the temperature in the freezer compartment undesirably goes up or down, depending upon the desired temperature change in the fresh food compartment.

Control interaction in the opposite direction, that is, fresh food compartment temperature variations as a result of changes in the setting of the freezer control, is not a significant problem because fresh food compartment temperature is substantially thermostatically maintained.

A further disadvantage which follows from the basic disadvantage of control interaction is that it is impossible to calibrate the freezer control directly in temperature. Any calibration of the freezer control directly in temperature would be valid only for a particular setting of the fresh food control.

Despite these disadvantages, the above-described prior art system enjoys wide use due to its relative simplicity and low cost. This points up the strict requirement that any improved system, to be practical, must also be relatively simple and low in cost.

A simple approach to the problem would be explaining to the user of the refrigerator the need to readjust the freezer control every time the setting of the fresh food control is changed. An astute user could adjust the controls to maintain the temperatures he desired in both compartments. The labeling of the "fresh food control" as a "cold control" in some refrigerator models is a step in this direction. However, there are problems in such an approach. A refrigerator with controls which appear complex to operate might be more difficult to sell. In the same vein, a detailed explanation might only serve to point out to a potential customer just how much undesirable control interaction there is. Further, many users either would not fully understand an explanation or would simply choose to ignore it.

It is known to mechanically overcome the abovedescribed interactive control problem by thermostatically adjusting the damper in the duct carrying refrigerated air from the evaporator chamber to the fresh food compartment. In such a system, employing what is termed a "thermal damper," the freezer control does not control the damper directly, but rather is connected to a thermostatic control which senses the temperature in the freezer compartment. The control adjusts the damper opening in response to both the freezer compartment temperature and the control setting to thermostatically maintain the freezer compartment temperature. Although such a system works well, it suffers the disadvantage of added complexity with attendant higher cost and greater possibility of failure in use.

Another known way to achieve truly independent temperature control for the fresh food and freezer compartment is to provide separate thermostatically controlled fans for directing refrigerated air from the evaporator chamber to each of the compartments. Each of the fans is controlled in response to a thermostatic control located in the corresponding compartment. Such a system is disclosed in U.S. Pat. No. 3,005,321-Devery. While this system also should effectively provide independent control of the temperatures in the two compartments, it too suffers the disadvantage of complexity. Further, it would require extensive changes to existing refrigerator designs to implement it.

The present invention overcomes the problem of control interaction to provide truly independent control over freezer and fresh food compartment temperature and yet avoids complexity. Certain specific embodiments are highly compatible with existing refrigerator designs and can be implemented with minimal retooling. The controls retain the same outward appearance as before but are improved in that they do exactly what is expected of them.

SUMMARY OF THE INVENTION

It is therefore an object of the invention to provide a single evaporator, single fan type refrigerator having substantially independent freezer and fresh food compartment temperature controls.

It is another object of the invention to provide such a refrigerator having independent controls and which is simple and economical to manufacture and trouble-free in use.

These and other objects are accomplished by the present invention which is an improvement of a refrigerator of the type generally comprising: A freezer compartment; a fresh food compartment; an evaporator in an evaporator chamber; and an air circulation system including a fan, passageways for circulating air from both of the compartments through the evaporator chamber, a passageway for conducting a first stream of air from the evaporator chamber to the freezer compartment and a duct for conducting a second stream of air from the evaporator chamber to the fresh food compartment. The refrigerator also includes a first user-operable control member for setting a desired temperature to be maintained in the freezer compartment, designated the "freezer control," and a second user-operable control member for setting a desired temperature to be maintained in the fresh food compartment. As is conventional, the second user-operable control member is designated the "fresh food control" and is operatively connected to a thermostatic control which includes an element for sensing fresh food compartment temperature and which controls the energization of the evaporator to approximately maintain the second preset temperature in the fresh food compartment.

Positioned in the duct for conducting a second stream of refrigerated air from the evaporator chamber to the fresh food compartment is apparatus for varying the airflow through the duct. In accordance with the invention, the airflow through the duct is varied as a function of both the setting of the freezer control and the setting of the fresh food compartment control, the fresh food compartment temperature control member being ganged so as to be operatively connected both to the thermostatic control and to the variable airflow control apparatus. In effect, the ganged connection from the fresh food control to the variable airflow control apparatus serves to provide compensation to prevent changes in freezer temperature which would otherwise result when the setting of the fresh food control is changed. As is conventional, the airflow through the duct is controlled as a direct function of the temperature setting of the freezer control; for example, as the freezer temperature control setting is increased, the airflow is increased. In accordance with the invention, duct airflow is also controlled as an inverse function of the temperature setting of the fresh food compartment control; for example, as the fresh food temperature control setting is increased, thereby conventionally varying the thermostatic control adjustment, the duct airfow is decreased to provide compensation.

In operation, as the thermostatic fresh food compartment temperature control is manually changed to call, for example, for a higher temperature, the compressor and evaporator, as outlined in the "Background of the Invention," operate less frequently and the fresh food temperature desirably decreases. If no compensation were provided, then the temperature of the freezer compartment would also increase, undesirably. The compensation which the present invention provides through a second input to the variable airflow control apparatus, which input is ganged to the fresh food compartment temperature control, overcomes the undesirable effect.

In one specific embodiment of the invention, the desired function may simply and effectively be provided by positioning first and second movable air-restricting members, such as dampers, in the duct. The first damper is conventionally connected directly to the freezer control and the second damper is ganged to operate with the fresh food compartment control.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

FIG. 2 is a graphical illustration of the temperature control characteristic curve for the control system included in the refrigerator shown in FIG. 1.

FIG. 3 is a graphical illustration of an optimum temperature control characteristic curve.

DESCRIPTION OF THE PREFERRED EMBODIMENTS

Figure 1:
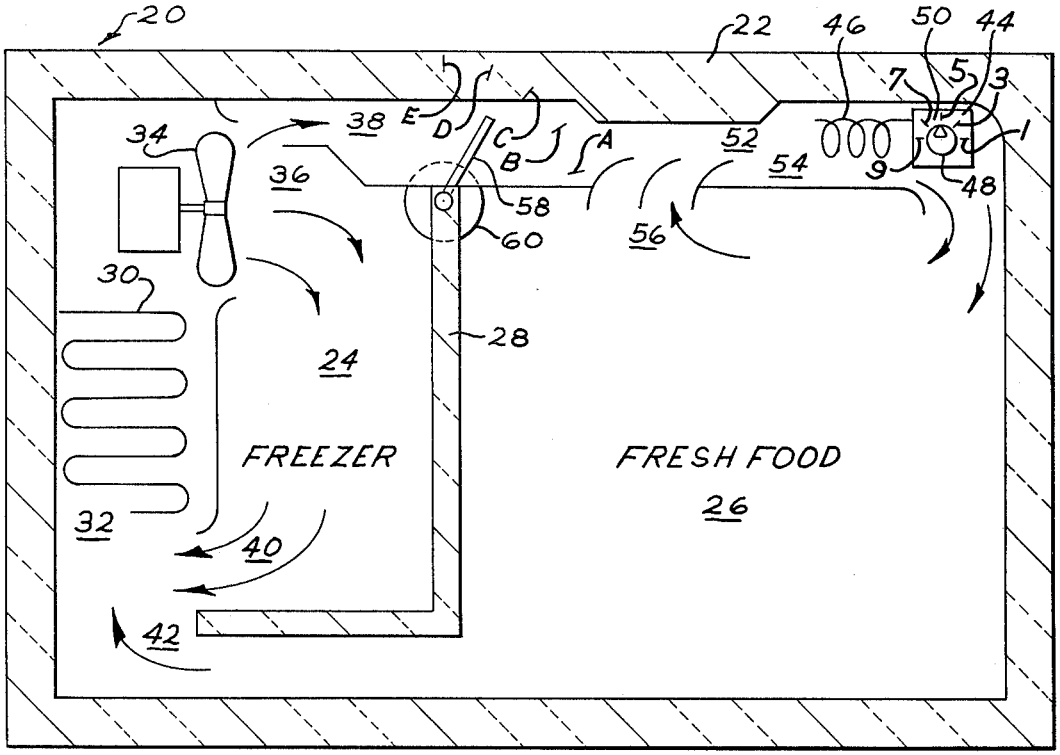
FIG. 1 PRIOR ART
FIG. 1 is a schematic representation of a refrigerator having a prior art temperature control system.

Referring first to FIG. 1, there is illustrated, in schematic form, essential elements of a prior art single evaporator, single fan combination refrigerator 20 as typified by the refrigerators disclosed in the above-mentioned U.S. Pat. Nos. 3,126,717-Schumacher and 3,320,761-Gelbard. It is believed that the present invention and the operation thereof will be better understood with reference to the prior art refrigerator 20 which the invention improves. A description of the prior art refrigerator 20 therefore follows.

The refrigerator 20 generally comprises an insulated outer wall 22 defining a freezer compartment 24 and a fresh food compartment 26. The two compartments are separated by an insulated partition 28. An evaporator 30 for refrigerating the compartments 24 and 26 is contained within an evaporator chamber 32. It will be understood that the refrigerator 20 includes a conventional closed refrigerant circuit (not shown) for energizing the evaporator 30, the refrigerant circuit comprising the usual compressor, condenser, and flow restricting capillary tube. It will further be understood that a conventional radiant heater (not shown) which is periodically energized to defrost the evaporator 30 is also provided.

The refrigerator 20 also includes an air circulating system comprising a fan 34, a passageway 36 for conducting a first stream of air from the evaporator chamber 32 to the freezer compartment 24, a duct 38 for conducting a second stream of air from the evaporator chamber 32 to the fresh food compartment 26, and passageways 40 and 42 for conducting air from the two compartments back to the evaporator chamber 32. Typically, the volume of the first stream of air circulating through the freezer compartment 24 comprises approximately 90% of the total airflow through the evaporator chamber 32, with the airflow through the fresh food compartment 26 making up the remaining 10%.

In order to thermostatically maintain the desired temperature in the fresh food compartment 26, a thermostatic temperature control 44 controls the operation of the compressor (not shown), and thus energization of the evaporator 30 as needed. The thermostatic control 44 comprises a temperature sensing element such as a temperature sensing capillary 46 and an electrical switch (not shown). A user-operable control member 48, designated the "fresh food control" is operatively connected to the thermostatic control 44. In order to reduce customer complaints which might arise if actual temperatures were indicated on the scale 50 associated with the control member 48, the scale 50 includes arbitrary graduations 1 through 9, 1 being the warmest and 9 being the coldest position.

Preferably, the refrigerated air conducted from the evaporator chamber 32 through the duct 38 into the fresh food compartment 26 is discharged through a nozzle 52 into a mixing chamber 54 so designed that a proportioned amount of fresh food compartment air is drawn through an opening 56 into the mixing chamber 54 by the aspirating effects induced by the air from the nozzle 52 and becomes mixed therewith before the temperature is sensed by the capillary 46 and before the air passes into the fresh food compartment 26. It will be apparent therefore that, rather than merely sensing the temperature of fresh food compartment air, when the fan 34 is running, the temperature sensing capillary 46 associated with thermostatic control 44 actually senses the temperature of a mixture of recirculated fresh food compartment air and refrigerated air supplied to the fresh food compartment 26 from the evaporator chamber 32. Such a system reduces the actual fresh food compartment air temperature drop needed to turn the thermostatic control 44 from the "on" to "off," thereby maintaining the fresh food temperature within closer limits than would otherwise be possible. Since the temperature sensed by the capillary 46 is related to the temperature in the fresh food compartment 26, for the purpose herein, the phrase "for sensing temperature in the fresh food compartment" is intended to include such a system. Further details of the nozzle 52, the mixing chamber 54, and the operation thereof are disclosed in the above-mentioned U.S. Pat. No. 3,320,761-Gelbard.

In order to provide control over the air temperature in the freezer compartment 24, an airflow damper 58 is positioned in the duct 38 and operatively connected to a user-operable control member 60. The control member 60 is designated the "freezer control" and has graduations A through E. To obtain a colder temperature in the freezer compartment 14, the freezer control 60 is manually moved towards the E position, causing the damper 58 to further restrict airflow through the duct 38. Due to the resulting decreased refrigerated air supply to the fresh food compartment 26, the evaporator 30 is energized for a greater percentage of time to satisfy cooling requirements of the fresh food compartment 26 and to maintain the temperature thereof. Energization of the evaporator 30 occurs, of course, whenever the thermostatic control 44 causes the compressor to operate. Since the temperature within the freezer compartment 24 primarily depends upon the percentage of time the evaporator 30 is energized, the freezer temperature is lowered, as desired.

Conversely, moving the freezer control 60 towards the A position opens the damper 58 more, resulting in more refrigerated air from the evaporator chamber 32 flowing through the duct 38 into the fresh food compartment 26. This results in the evaporator being energized less often or for shorter periods of time, causing a higher freezer compartment temperature, as desired.

While only a single duct 38 and a single damper 58 are illustrated, in certain refrigerators the duct 38 is divided into two parallel ducts and a damper is included in each duct. The dampers operate together, so the effect is the same.

The indications associated with the position of the freezer control 60 and the damper 58 necessarily are not calibrated in temperature because, in the prior art refrigerator 20, the actual temperature in the freezer compartment 24 is also dependent upon the setting of the fresh food control 48, as is explained in greater detail in the "Background of the Invention".

Referring now to FIG. 2, exemplary temperature control characteristic curves for the temperature control system in the prior art refrigerator 20 described above with reference to FIG. 1, are graphically illustrated. The characteristic curves show the temperatures to be expected in both the freezer compartment 24 and the fresh food compartment 26 for various combinations of settings of the fresh food control 48 and the freezer control 60. The effects of the two controls are easily distinguished on the graph because the fresh food control 48 has numbered graduations and the freezer control 60 has lettered graduations. For example, if the fresh food control 48 is set at 5 and the freezer control is set at C, it can be determined, from the point designated 62, that the temperature in the freezer compartment 24 is approximately −1° F and the temperature in the fresh food compartment 26 is approximately 34° F. To graphically illustrate the interaction of the fresh food temperature control 48 on the temperature in the freezer compartment 24 in the prior art system, consider an exemplary situation where the freezer control 60 remains set at C and the fresh food compartment temperature control 48 is moved from 5 to 1, calling for a warmer fresh food temperature. The resulting control point is designated 64. As desired, the temperature in the fresh food compartment 26 rises to approximately 38° F. Undesirably, the temperature in the freezer compartment 24 also rises, up from −1° F to 5° F. It will be apparent from the curves shown in FIG. 2 that the interactive effect of the fresh food control 48 on the temperature in the freezer compartment 24 is reflected on the graph by the lines which slope downwardly and to the left beginning at each of the letters A through E. Since the temperature in the fresh food compartment 26 is more nearly maintained at any desired temperature by thermostatic control action, there is very little corresponding interaction of the setting of the freezer control 60 on the temperature in the fresh food compartment 26. This is reflected on the graph by the substantially vertical lines extending downwardly from each of the numbers 1, 3, 5, 7 and 9.

Referring to FIG. 3, desired temperature control characteristic curves are graphically illustrated. As is evident from FIG. 3, desirably the settings of the fresh food compartment control 48 (represented by numbers 1, 3, 5, 7 and 9) affect only the temperature in the fresh food compartment 26 and have no effect on the temperature in the freezer compartment 24. Apparatus according to the present invention, by proper adjustment of the preferred embodiments thereof, can achieve a temperature control characteristic similar to that of FIG. 3. Other specific embodiments of the invention can achieve characteristics which are somewhere midway between the prior art characteristics shown in FIG. 2 and the desired characteristics shown in FIG. 3.

Figure 4:
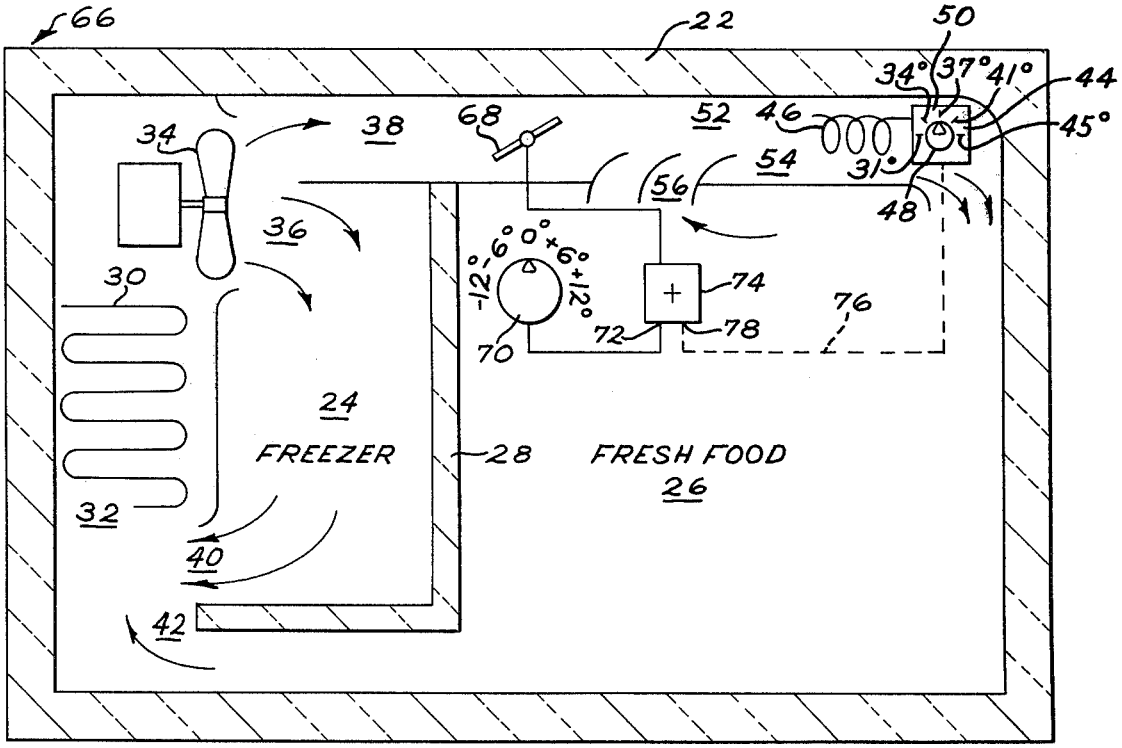
FIG. 4 is a schematic representation of a refrigerator including generalized apparatus according to the present invention to achieve the temperature control characteristic curve illustrated in FIG. 3.

Referring next to FIG. 4, there is illustrated, in schematic form, essential elements of a refrigerator 66 constructed in accordance with and including generalized apparatus according to the present invention to achieve the temperature control characteristic curve illustrated in FIG. 3. With the exception of the freezer temperature control system, the basic elements of the refrigerator 66 are common to many refrigerators and are unchanged from the prior art refrigerator discussed above with reference to FIG. 1. The detailed description of these common elements is therefore not repeated. The damper 58 of the prior art refrigerator 20 illustrated in FIG. 1 is replaced by a more general representation of an airflow control member 68, in the refrigerator 66 as shown in FIG. 4. A user-operable freezer control member 70 is not connected directly to the airflow control member 68, but rather, is connected to a main input 72 of the combiner shown in generalized form at 74.

The airflow control member 68 and the combiner 74 together comprise variable airflow control apparatus for varying airflow through the duct 38 as a function of both the setting of the freezer control member 70 (sometimes referred to herein as the "first user-operable control member") and the setting of the fresh food control member 48 (sometimes referred to herein as the "second user-operable control member"). As is conventional, the airfow through the duct 38 is controlled as a direct function of the temperature setting of the freezer control 70; that is, as the control 70 is adjusted to call for higher freezer temperatures, the airflow through the duct 38 is increased, and, as the control 70 is manually adjusted to call for lower freezer temperatures, the airflow through the duct 38 is decreased. In addition to being operatively connected to the thermostatic control 44, the fresh food control 48 is operatively connected through a ganged connection designated 76 to a compensating input 78 of the combiner 74. The ganged connection 76 from the fresh food control 48 to the combiner 74 serves as a compensating input used by the variable airflow control apparatus to prevent changes in freezer temperature which would otherwise result when the setting of the fresh food control 48 is changed. The airflow through the duct 38 is controlled as an inverse function of the temperature setting of the fresh food control 48; that is, as the fresh food control 48 is manually adjusted to call for a higher temperature to be maintained in the fresh food compartment 26, the variable airflow control apparatus causes the airflow through the duct 38 to be decreased, and, as the fresh food control 48 is adjusted to call for a lower temperature to be maintained in the fresh food compartment 26, the variable airflow control apparatus causes the airflow through the duct 38 to be increased.

While the combiner 74 is shown as a "black box" having a + sign on it, it will be understood that the combiner 74 and the airflow control member 68, which together comprise the variable airflow control apparatus, can be any system which varies airflow through the duct 38 in the manner outlined above to maintain the first preset temperature in the freezer compartment 24 despite changes in the setting of the fresh food control 48. The particular mathematical function employed is determined by experimentation which is well within the ability of those skilled in the art, once the concept of applying a compensating input to the variable airflow control apparatus in the duct 38 is appreciated. The + sign indicates merely that the two inputs are combined and is not intended to mean that the two inputs are necessarily added or that the functions are necessarily linear functions.

In the operation of the generalized embodiment shown in FIG. 4, as the fresh food control 48 is manually changed to call, for example, for a higher temperature, the compressor and evaporator 30, under control of the thermostatic control 44, operate less frequently. Desirably, temperature in the fresh food compartment 26 increases. If no compensation were provided, then, undesirably, temperature in the freezer compartment 24 would also increase. The compensation which the present invention provides through the ganged connection 76 causes the airflow control member 68 to further restrict airflow through the duct 38, just as if the freezer control 70 had been manually adjusted to call for a lower freezer temperature. The compensation, when properly adjusted, causes the freezer temperature to remain substantially constant. Conversely, as the fresh food control 48 is manually changed to call, for example, for a lower temperature, the evaporator 30 operates more frequently and the fresh food temperature desirably decreases. In order to compensate for the undesired decrease in freezer temperature which would otherwise result, the airflow through the duct 38 is caused to increase.

Figure 5:
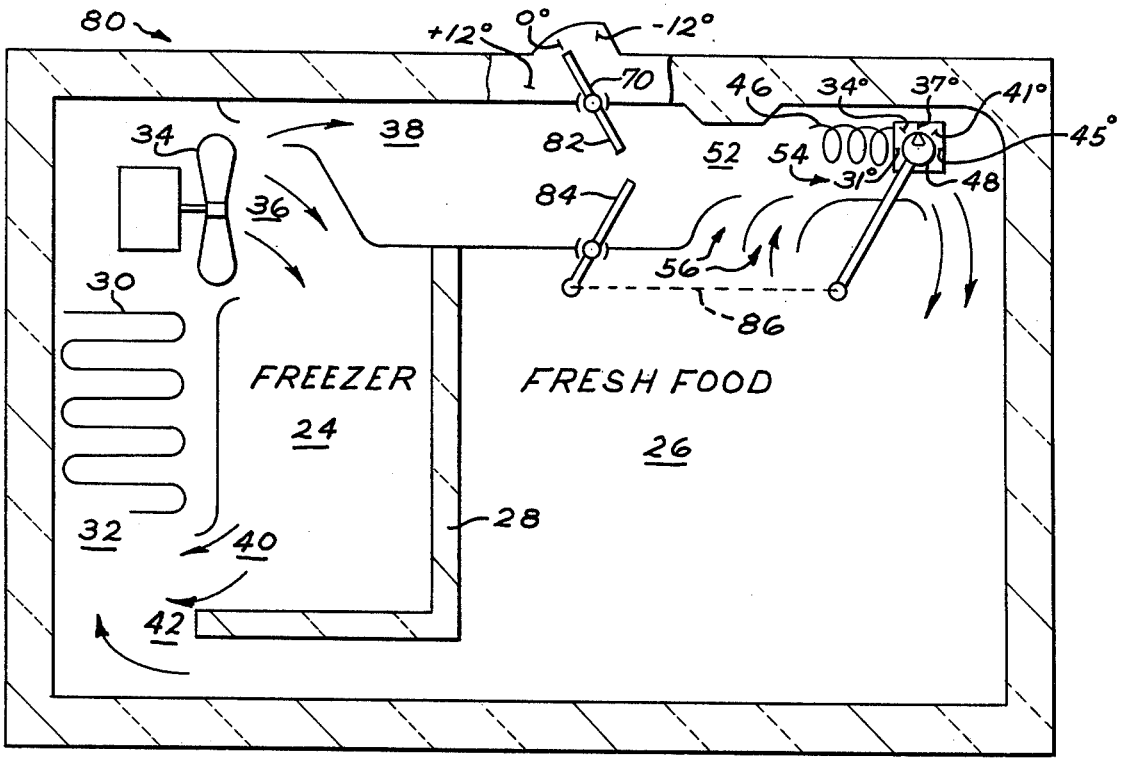
FIG. 5 is a schematic representation of a refrigerator including an embodiment of the present invention comprising two adjustable dampers in a single duct.

Referring now to FIG. 5, there is illustrated, in schematic form, essential elements of a refrigerator 80 constructed in accordance with and employing features of a specific embodiment of the present invention. As in the above description of the refrigerator (FIG. 4), a detailed description of those elements which are common to refrigerators is not repeated.

In the refrigerator 80, the variable airflow control apparatus for varying the airflow through the duct 38 comprises a first movable air restricting member, shown as a damper 82, operatively connected to the freezer control 70. A second movable air restricting member, shown as a damper 84, is operatively connected to the fresh food control 48 through a ganged connection 86 (broken lines). It will be apparent that the dampers 82 and 84 cooperate to define therebetween an opening of variable size, the size of the opening, and therefore airflow through the duct 38, being a function of both the setting of the freezer control 70 and of the fresh food control 48. In the specific embodiment of the invention shown in FIG. 5, the inputs from the control members 70 and 48 are combined right at the movable air-restricting members, rather than in a separate combiner 74, as in the general embodiment shown in FIG. 4. The end result and principles of operation are the same. In FIG. 5, the main input of the variable airflow control apparatus is that portion of the damper 82 to which the freezer control member 70 (first user-operable control member) is attached. Similarly, the compensating input of the variable airflow control apparatus is that portion of the damper 84 to which the ganged connection 86 from the fresh food control member 48 (second user-operable control member) is made.

The ganged connection 86 can be any means which provides the necessary ratio of movement of the damper 84 to movement of the fresh food control 48 and can comprise, for example, a belt and pulley arrangement or a simple lever.

Through proper adjustment of the temperature control system of the refrigerator 80, proper compensation for the undesirable effect of changes of the setting of the fresh food control 48 on the temperature in the freezer compartment 24 can be effected, thereby achieving a desirable temperature control characteristic such as that graphically illustrated in FIG. 3. Proper adjustment of the compensation requires experimentation, well within the skill of one skilled in the art, to determine the proper amount of compensation for each particular model of refrigerator. Once determined for a particular model, the compensation will remain substantially constant for each production copy manufactured.

Referring now, collectively, to FIGS. 6 through 11, there are shown other forms of first and second movable air restricting members which may be positioned in the duct 38, instead of the dampers 82 and 84 (FIG. 5). It will be understood that any of the embodiments disclosed in FIGS. 6 through 11 can be included in the refrigerator 80 of FIG. 5 and, for convenience of illustration, the duct portion only is shown, with other elements remaining substantially unchanged.

In FIGS. 6 through 11, the fresh food control 48 and the freezer control 70 are not shown, but it will be understood that they are included in the refrigerator 80 and operatively connected to the first and second movable air restricting members. It will further be understood that either manually operable control member can be connected to either movable air restricting member, so long as the proper relationship between control settings and airflow is maintained. Depending upon the particular connection made, the main input to the variable airflow control apparatus will be understood to be that portion of the first movable air restricting member to which the freezer control 70 is operatively attached and the compensating input to the variable airflow control apparatus will be understood to be that portion of the second movable air restricting member to which the fresh food control 48 is operatively attached.

Figure 6:
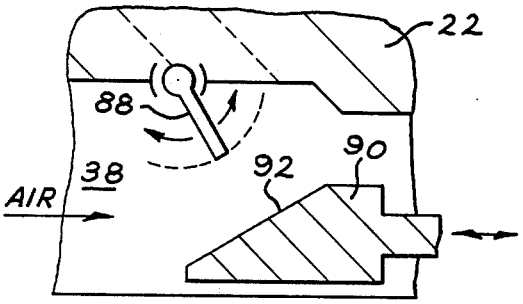
FIG. 6 is a fragmentary section of the duct portion of a refrigerator including another embodiment of the present invention.

Referring now particularly to FIG. 6, one of the movable air restricting members is a damper 88 and the other is a plug 90 having an inclined surface 92 facing the damper 88. The size of the opening between the damper 88 and the plug 90 is a function of both the position of the damper 88 and of the plug 90.

Figure 7:
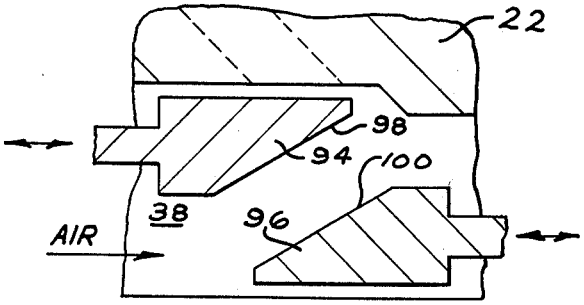
FIG. 7 is a view similar to FIG. 6, showing yet another embodiment of the present invention.

Referring particularly to FIG. 7, both of the movable air restricting members are plugs designated 94 and 96, and have facing inclined surfaces 98 and 100.

Figure 8:
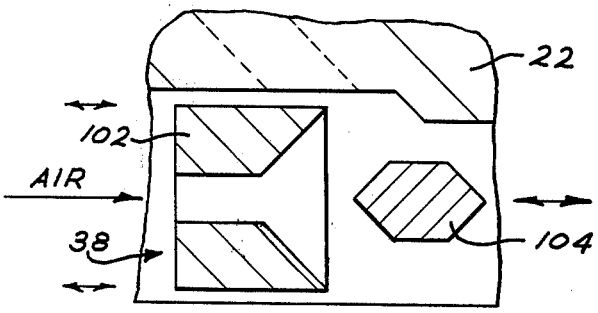
FIG. 8 is a view similar to FIG. 6, showing yet another embodiment of the present invention.

In the embodiment shown in FIG. 8, the movable air restricting members together comprise a needle valve, the seat 102 being the first movable air restricting member and the needle 104 being the other movable air restricting member.

Figure 9A:
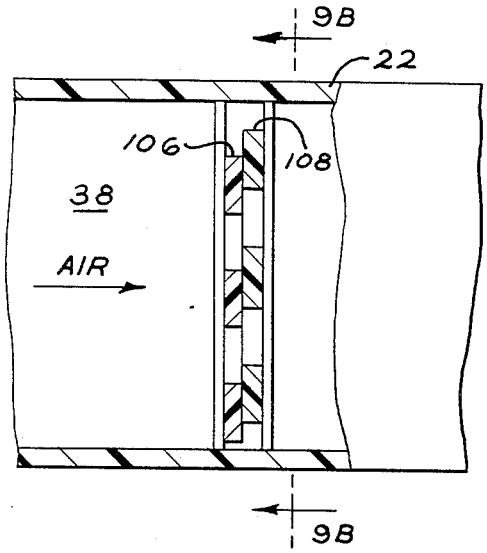
FIG. 9A is a view similar to FIG. 6 showing still another embodiment of the present invention.
Figure 9B:
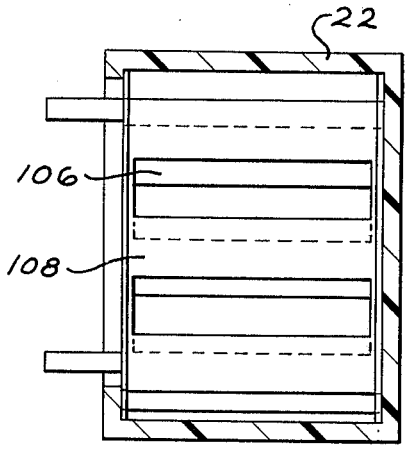
FIG. 9B is a section along lines 9B—9B of FIG. 9A.

Referring now to FIGS. 9A and 9B, the movable air restricting members are relatively movable, slotted shutters 106 and 108. Each of the shutters 106 and 108 is operatively connected to one of the manually operable control members.

Figure 10A:
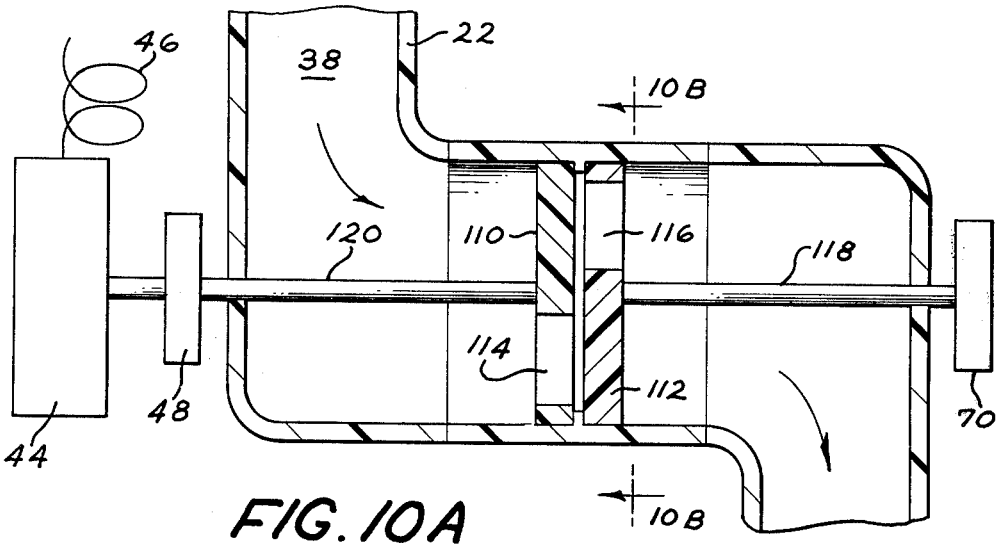
FIG. 10A is a view similar to FIG. 6 showing still another embodiment of the present invention.
Figure 10B:
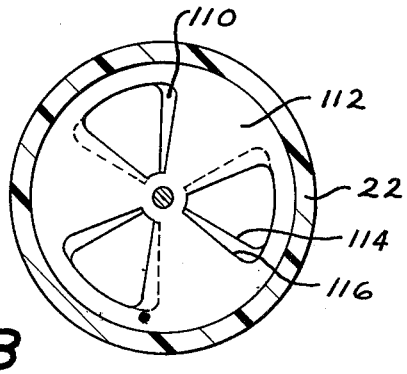
FIG. 10B is a view along the lines 10B—10B of FIG. 10A.

Referring to FIGS. 10A and 10B, the movable air restricting members are discs 110 and 112 having corresponding openings 114 and 116. As illustrated in FIG. 10A, the disc 112 is connected by a rotatable shaft 118 to the freezer control 70 and the disc 110 is connected by a rotatable shaft 120 to the fresh food control 48. Additionally, the fresh food control 48 is conventionally connected to the thermostatic control 44. The temperature sensing capillary 46 is shown in schematic representation only, it being understood that the temperature sensing capillary 46 is actually placed in a position such that it senses temperature within the fresh food compartment 26. The size and shape of the openings 114 and 116 are so selected to achieve variable air restriction as the desired function of the setting of the control members 48 and 70.

Figure 11:
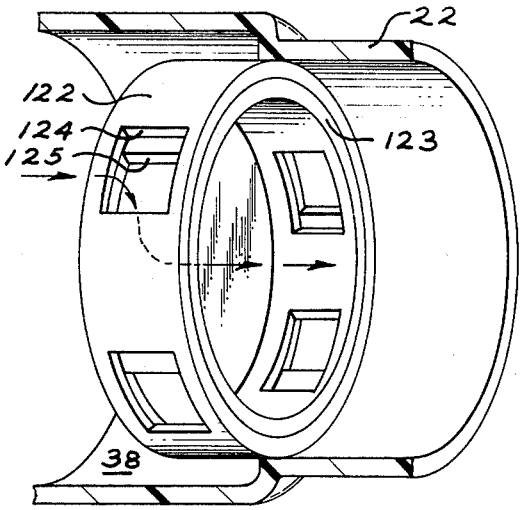
FIG. 11 is a view similar to FIG. 6 showing still another embodiment of the present invention.

Referring now, finally, to FIG. 11, the first and second movable air restricting members are rotatable coaxial cylinders 122 and 123 having corresponding openings 124 and 125. Each of the cylinders 122 and 123 is operatively connected to one of the manually operable control members. It will be apparent that the relative positions of the cylinders 122 and 123 define openings of variable size.

It will be apparent that in each of the embodiments, shown in FIGS. 5 through 11, the airflow through the duct 38 is a function of the size of the opening defined between the first and second movable air restricting members and, therefore, a function of both the setting of the first user-operable control member (freezer control member 70) and the setting of the second user-operable control member (fresh food control member 48). Each of the embodiments shown in FIGS. 5 through 11 is capable of being adjusted to achieve a control characteristic curve similar to that shown in FIG. 3. Many combinations of size and shape of the openings which would achieve the desired results are possible. In the embodiments illustrated in FIGS. 9 through 11, each of the movable air restricting members includes a plurality of openings corresponding to openings in the other member. Similar configurations, however, having only one opening in each member might be employed.

Figure 12:
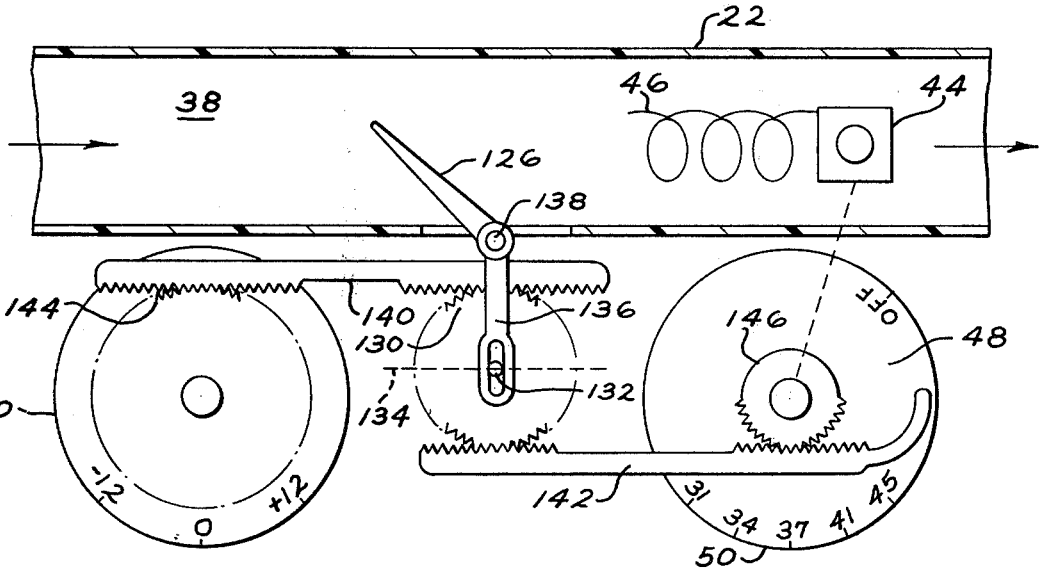
FIG. 12 shows another embodiment of the present invention, the embodiment including a mechanical summer employing gears.

Referring now to FIG. 12, there is illustrated another specific embodiment of variable airflow control apparatus for inclusion in a refrigerator, which apparatus also embodies certain broader aspects of the present invention. The specific embodiment, illustrated in FIG. 12, however, is not the subject matter of the present invention, but, rather, forms a part of the subject matter of a copending application Ser. No. 646,196, filed concurrently herewith, by William F. Hester, also entitled SINGLE EVAPORATOR, SINGLE FAN COMBINATION REFRIGERATOR WITH INDEPENDENT TEMPERATURE CONTROLS, and assigned to the same assignee as the present invention. While a brief description of the embodiment illustrated in FIG. 12 follows, reference is hereby made to the above-mentioned Hester application Ser. No. 646,196 for additional details and features thereof.

The embodiment of FIG. 12 includes a damper 126 disposed within the duct 38 for controlling airflow therethrough as a function of both the temperature setting of the fresh food control 48 and of the freezer control 70. Variable airflow control apparatus comprises, in addition to the damper 126, a mechanical summer or differential 128. The summer 128 includes a main input connected to the freezer control 70 and a compensating input connected to the fresh food control 48. As will be more apparent from the following detailed description of the embodiment, the degree of damper opening is a direct function of the temperature setting of the freezer control 70 and an inverse function of the temperature setting of the fresh food control 48.

The mechanical summer 128 comprises a driven pinion gear 130 including an axle 132, the axis of the pinion 130 and of the axle 132 being translatable along a line shown by broken line 134. It will be understood that the representation in FIG. 12 is in schematic form only and various supporting and guiding members must be employed to hold the various elements in their proper relative positions. The damper 126 is operatively attached to be driven by a slotted yoke member 136, the slot of the yoke being placed over the axle 132 for movement thereby. Translational movement of the axle along the line 134 causes the slotted yoke 136 and the damper 126 to move about the pivot point 138 to vary the opening of the damper 126.

The mechanical summer further comprises first and second racks 140 and 142 engaging the pinion gear 130 on diametrically opposite sides. The position of the translatable axis along the line 134 represents the sum of the longitudinal displacements of the first and second racks 140 and 142, respectively. Additionally, first and second driving gears 144 and 146 are connected to the freezer control 70 and the fresh food control 48 and engage the first and second racks 140 and 142 to cause longitudinal displacement thereof in response to operation of the freezer control 70 and the fresh food control 48. The portions of the driving gears 144 and 146 connected to the freezer control 70 and the fresh control 48 may be considered the main and compensating inputs, respectively, of the summer 128.

In the operation of the embodiment illustrated in FIG. 12, manual rotation of either the freezer control 70 or the fresh food control 48 causes the corresponding rack 140 or 142 to be longitudinally displaced. Displacement of the rack 140 or 142 causes translation of the pinion 130 and the axle 132. The slotted yoke member 136 produces movement of the damper 126 to effect the desired change in airflow. For normal freezer temperature control, for example, as the freezer control 70 is rotated clockwise to call for higher freezer temperatures, the rack 140 displaces to the right and the pinion gear 130 and axle 132 translate to the right. This causes the yoke 136 and the damper 126 to rotate counterclockwise about the pivot point 132, opening the damper 126 more to permit increased duct airflow. As previously explained, increased airflow through the duct 38 indirectly causes a desired increase in freezer temperature.

Still considering the operation of the embodiment of FIG. 12, if the fresh food control 48 is rotated clockwise, for example, to call for a higher fresh food temperature, the rack 142 is displaced to the left and the pinion gear axle 132 translates to the left. The yoke member 136 and the damper 126 rotate clockwise about the pivot point 132, thereby further restricting duct airflow to provide compensation, as in the previously described embodiments.

Figure 13:
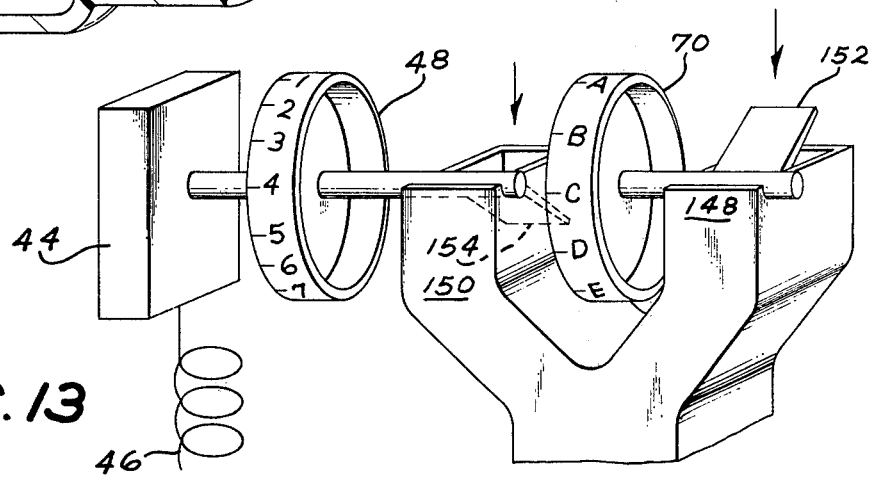
FIG. 13 shows another embodiment of the present invention comprising two parallel ducts with a damper in each duct.

Referring now to FIG. 13, there is illustrated still another specific embodiment of variable airflow control apparatus embodying certain broader aspects of the present invention. The specific embodiment illustrated in FIG. 13, however, is not the subject matter of the present invention, but, rather, is the sole invention of William M. Webb.

In FIG. 13, duct airflow, rather than being from left to right, is from top to bottom and the single duct 38 is divided into first and second parallel ducts 148 and 150. The ducts 148 and 150 combine in a Y junction back to a single duct before discharging into the fresh food compartment 26. The particular configuration of first and second parallel ducts 148 and 150 is used in certain prior art refrigerator models where it is desired to locate the freezer control 70 on the centerline of the duct 38. In such prior art refrigerators, shafts extending from either side of the control 70 operate identical dampers in each duct, the dampers operating together.

In the embodiment shown in FIG. 13, the freezer control 70 is connected to operate a first damper 152 disposed in the first parallel duct 148. The portion of the first damper 152 to which the freezer control 70 is connected is the main input of the variable airflow control apparatus. Conventionally, as the freezer control 70 is moved toward the E or coldest position, the damper 152 closes more, thereby decreasing airflow through the duct 148. As the freezer control 70 is moved toward the A or warmest position, the damper 152 opens more, increasing the airflow through the duct.

In accordance with the present invention, a second damper 154 (dash lines) is included in the second parallel duct 150 and is connected to the fresh food control 48 for ganged operation along with the thermostatic control 44. The portion of the second damper 154 to which the ganged connection from the fresh food control 48 is made is the compensating input of the variable airflow control apparatus. In order to provide compensation for changes in freezer temperature which would otherwise result when the temperature setting of the fresh food control 48 is changed, the damper 154 restricts airflow more when the fresh food control 48 is moved toward 1 or the warmest position and as the fresh food control 48 is moved toward 9 or the coldest position, the damper 154 allows more airflow through the duct 150.

Figure 14:
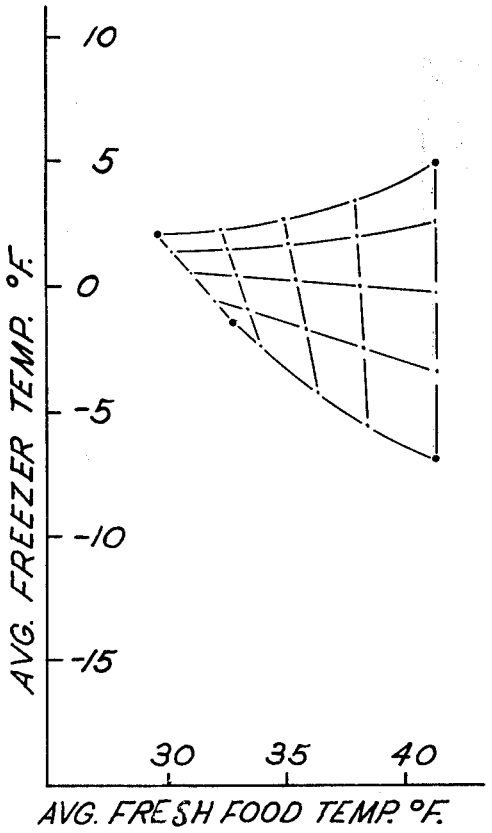
FIG. 14 is a graphical illustration of the temperature control characteristic curve of the embodiment shown in FIG. 13.

Referring now to FIG. 14, the temperature control characteristic curves of the embodiment shown in FIG. 13 are illustrated graphically. The curves of FIG. 14 may be compared to the characteristic curves illustrated in FIGS. 2 and 3. It will be apparent from an examination of the curves in FIG. 14 that the embodiment of FIG. 13 does provide some compensation, but not as uniformly as is desirable.

Figure 15:
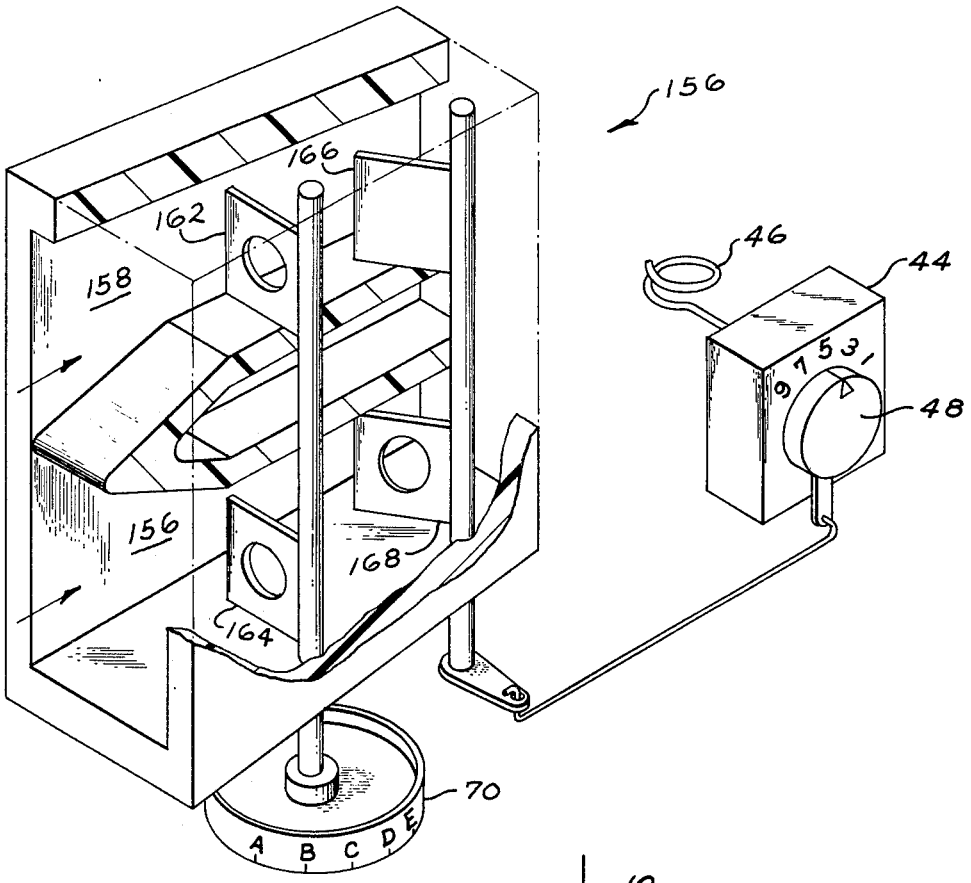
FIG. 15 is a perspective view of a preferred embodiment of the present invention which can substantially achieve the optimum temperature control characteristic curve illustrated in FIG. 3.

Referring next to FIG. 15, there is shown a perspective view of a preferred specific embodiment of variable airflow control apparatus 156 incorporating certain broader aspects of the present invention. The specific embodiment, however, illustrated in and described with reference to FIG. 15, is not the subject matter of the present invention, but, rather, forms a part of the subject matter of copending application Ser. No. 646,166, filed Jan. 2, 1976, concurrently herewith, by William M. Webb and Stephen G. Boughton, entitled SINGLE EVAPORATOR, SINGLE FAN COMBINATION REFRIGERATOR WITH INDEPENDENT TEMPERATURE CONTROLS, and also assigned to the same assignee as the present invention.

In the embodiment illustrated in FIG. 15, the duct 38 is divided into first and second parallel ducts 158 and 160. As is conventional, first and second main dampers 162 and 164 are disposed within the first and second parallel ducts 158 and 160 and are both operatively connected to the freezer control 70 so as to permit decreased airflow through the ducts 158 and 160 when the freezer control 70 is adjusted to call for a lower temperature to be maintained in the freezer compartment 24 and to permit increased airflow through the ducts 158 and 160 when the freezer control 70 is adjusted to call for a higher temperature to be maintained in the freezer compartment 24. The configuration thus far described with the exception of the holes in the dampers 162 and 164 is conventional and is in use in certain prior art refrigerator models. However, the portions of the main dampers 162 and 164 to which the freezer control 70 is connected is the main input, as contemplated by the invention, of the variable airflow control apparatus.

In accordance with the broader aspects of the present invention, first and second compensating dampers 166 and 168 are disposed within the ducts 158 and 160, respectively. Each of the compensating dampers 166 and 168 is operatively connected to the fresh food control 48 for ganged operation with the thermostatic control 44 so as to permit increased airflow through the ducts 158 and 160 when the fresh food control is adjusted to call for a lower temperature to be maintained in the fresh food compartment 26 and to permit decreased airflow through the ducts 158 and 160 when the fresh food control 48 is adjusted to call for a higher temperature to be maintained in the fresh food compartment 26. It will be apparent that the portion of the compensating dampers 166 and 168 to which the ganged connection from the fresh food control 48 is made is the compensating input of the variable airflow control apparatus. The combined airflow through the first and second ducts 158 and 160 therefore has the correct relationship to the settings of both the freezer control 70 and the fresh food control 48.

Still referring to FIG. 15, it will be apparent that the first compensating damper 166 is constructed to completely block airflow when in the fully closed position, and each of the other three dampers 162, 164 and 168 is constructed, through the use of a hole therethrough, to only partially block airflow when in the fully closed position. By proper adjustment of duct sizing and size of the openings, a desirable temperature compensating characteristic can be achieved by the airflow control apparatus 156. Further features and a method of adjustment are disclosed and claimed in the above-mentioned copending Webb and Boughton application Ser. No. 646,166, to which reference is hereby made.

Figure 16:
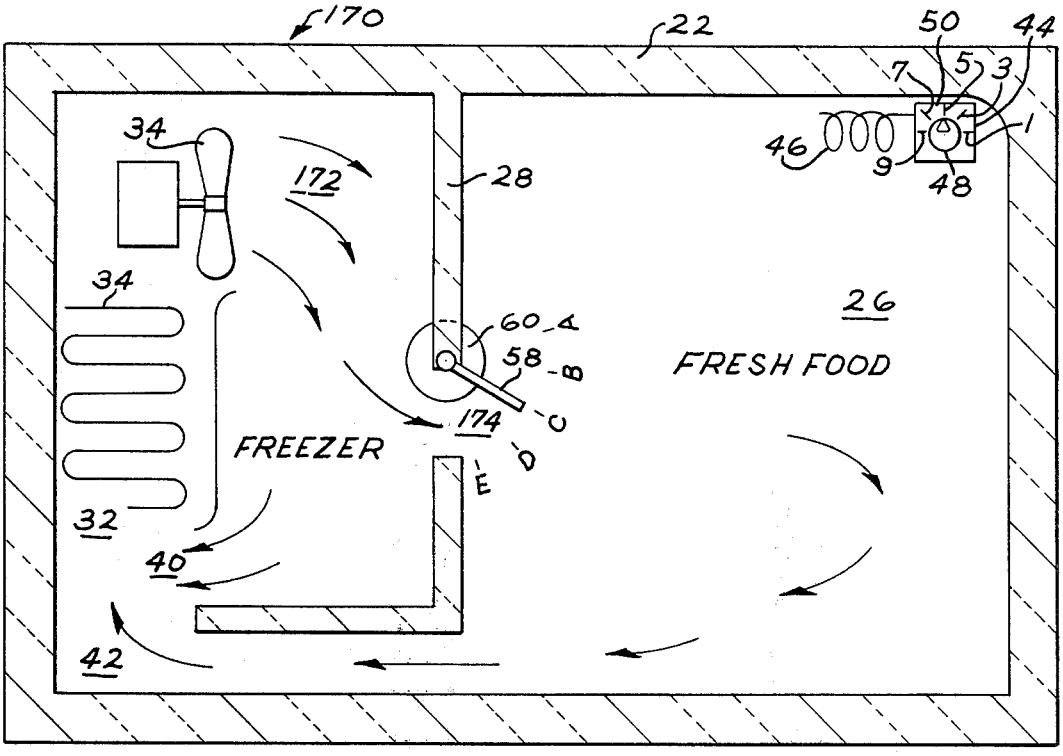
FIG. 16 PRIOR ART
FIG. 16 is a schematic representation of a refrigerator having another configuration of a prior art temperature control system.

Referring now to FIG. 16, there is illustrated a schematic representation of another prior art refrigerator 170 having a different temperature control and airflow configuration. A more detailed example of the type of refrigerator shown schematically in FIG. 16 is disclosed in U.S. Pat. No. 3,379,029-King.

The refrigerator 170 employs a minimum ducting configuration in which the evaporator chamber 32 has only one air outlet 172, the one air outlet 172 leading to the freezer compartment 24. There is no separate duct leading directly from the evaporator chamber 32 to the fresh food compartment 26. Refrigerated air for cooling the fresh food compartment 26 is supplied from the freezer compartment 24 through an opening 174 in the partition 28. Return passageways 40 and 42 conduct air from the freezer compartment 24 and the fresh food compartment 26 back to the evaporator 32, as in the previously described refrigerators. The conventional thermostatic control 44, operatively connected to the fresh food control 48, thermostatically maintains the temperature in the fresh food compartment 26 by cycling the compressor (not shown), and thus the evaporator 30, as required, to satisfy the cooling requirements of the fresh food compartment 26. A manually operable freezer control member 60 controls the opening of the damper 58 to vary the flow of cold air into the fresh food compartment 26, affecting compressor and evaporator run time and thereby indirectly varying the temperature in the freezer compartment 24.

It will be appreciated that while the configuration of the refrigerator 170 of FIG. 16 is different from the configuration of the refrigerator 20 (FIG. 1), the operation of the temperature control system is substantially identical. A description of the operation will not be repeated.

Figure 17:
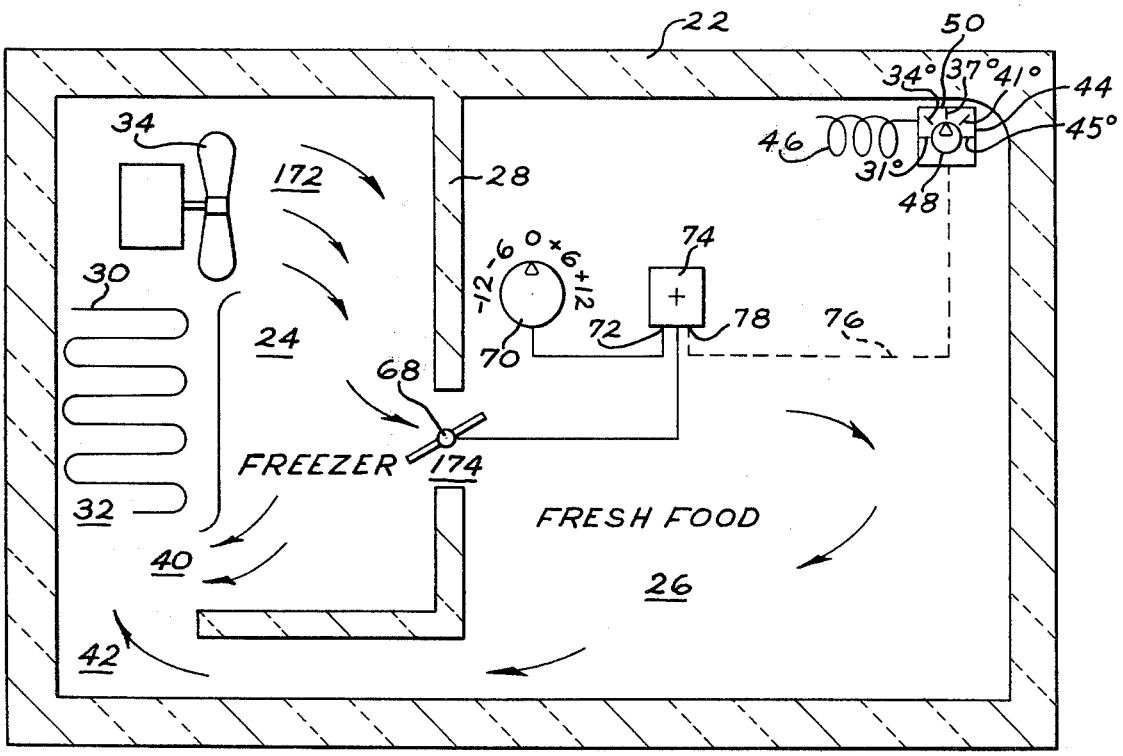
FIG. 17 is a generalized schematic of the present invention applied to a refrigerator of the type shown in FIG. 16.

Referring now to FIG. 17, there is shown a schematic representation of a refrigerator 174, similar to the refrigerator 66 shown in FIG. 4, illustrating how the present invention may be included in a refrigerator, such as refrigerator 170 (FIG. 16), which is of the type disclosed in the above-mentioned U.S. Pat. No. 3,379,029-King. In the refrigerator 174, the damper 58 is replaced by the more generalized representation of an airflow control member 68. As in the refrigerator 66 described above with reference to FIG. 4, a combiner 74 combines main and compensating inputs from the freezer control 70 and the fresh food control 48 to produce the required degree of opening of the airflow control member 68 to vary freezer temperature as set by the freezer control 70, but to maintain freezer temperature independently of the setting of the fresh food control 48.

It will be apparent that the present invention provides a single evaporator, single fan combination refrigerator which has substantially independent fresh food temperature controls. As in prior art refrigerators, control over freezer temperature is effected by a relatively simple airflow control member, such as a damper, which controls the flow of refrigerated air originating in the evaporator chamber into the fresh food compartment 26. In order to prevent undesirable changes in the temperature of the freezer compartment 24 when the temperature setting for the fresh food compartment 26 is changed, compensation for the undesirable changes which would otherwise occur is effected by varying the airflow of refrigerated air into the fresh food compartment as a function of the temperature setting of the fresh food control 48, as well as of a function of the setting of the freezer control 70.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A refrigerator comprising:

a. a freezer compartment;

b. a fresh food compartment;

c. an evaporator chamber and an evaporator in said chamber;

d. means for conveying air from both of said compartments through said evaporator chamber;

e. means for supplying refrigerated air from said evaporator chamber to said compartments;

f. a thermostatic control for maintaining a desired temperature in one of said compartments by causing energization of said evaporator as required, said thermostatic control including an element for sensing temperature in said one of said compartments;

g. a first user-operable control member for setting a desired temperature to be maintained in the other of said compartments;

h. a second user-operable control member for setting the desired temperature to be maintained in said one of said compartments, said second user-operable control member being operatively connected to said thermostatic control; and i. apparatus for apportioning the flow of refrigerated evaporator chamber air between said compartments as a function of the settings of both of said user-operable control members, said apparatus having a main input connected to said first user-operable control member and a compensating input connected to said second user-operable control member, and said function being selected so that the desired temperature is approximately maintained in said other of said compartments, even though the setting of said second user-operable control member is changed.

2. A refrigerator according to claim 1, wherein:

said one of said compartments is said fresh food compartment;

said other of said compartments is said freezer compartment; and said apparatus for apportioning the flow of air between said compartments apportions relatively more refrigerated evaporator chamber air to said fresh food compartment when said first user-operable control member is adjusted to call for a higher temperature to be maintained in said freezer compartment and when said second useroperable control member is adjusted to call for a lower temperature to be maintained in said fresh food compartment, and said apparatus apportions relatively less refrigerated evaporator chamber air to said fresh food compartment when said first user-operable control member is adjusted to call for a lower temperature to be maintained in said freezer compartment and when said second user-operable control member is adjusted to call for a higher temperature to be maintained in said fresh food compartment.

3. A refrigerator comprising:

a. a freezer compartment;

b. a fresh food compartment;

c. an evaporator chamber and an evaporator in said chamber;

d. an air circulation system including a fan and passageways for circulating air from both of said compartments through said evaporator chamber, a passageway for conducting a first stream of air from said evaporator chamber to said freezer compartment, and a duct for conducting a second stream of air from said evaporator chamber to said fresh food compartment;

e. a thermostatic control for maintaining a desired temperature in said fresh food compartment by causing energization of said evaporator as required, said thermostatic control including an element for sensing temperature in said fresh food compartment;

f. a first user-operable control member for setting a desired temperature to be maintained in said freezer compartment;

g. a second user-operable control member for setting the desired temperature to be maintained in said fresh food compartment, said second user-operable control member being operatively connected to said thermostatic control; and h. variable airflow control apparatus for varying the airflow through said duct, said variable airflow control apparatus varying airflow as a function of both the setting of said first user-operable control member and the setting of said second user-operable control member, said apparatus having a main input connected to said first user-operable control member and a compensating input connected to said second user-operable control member, and said function being selected so that the desired temperature is approximately maintained in said freezer compartment even through the setting of said second user-operable control member is changed.

4. A refrigerator according to claim 3, wherein said thermostatic control operates to cause energization of said evaporator when the temperature in said fresh food compartment exceeds the temperature setting of said second user-operable control member and to cause de-energization of said evaporator when the temperature in said fresh food compartment is less than the temperature setting of said second user-operable control member.

5. A refrigerator according to claim 4, wherein the airflow through said duct is controlled as a direct function of the temperature setting of said first user-operable control member and an inverse function of the temperature setting of said second user-operable control member.

6. A refrigerator according to claim 3, wherein said variable airflow control apparatus comprises:

a. a first movable air restricting member operatively connected to said first user-operable control member; and b. a second movable air restricting member operatively connected to said second user-operable control member;

said first and second movable air restricting members cooperating to define therebetween an opening of variable size, the size of said opening, and therefore airflow through said duct, being said function of both the setting of said manually-operable control member and the setting of said second manually-operable control member.

7. A refrigerator according to claim 6, wherein said first movable air restricting member is operatively connected to said first user-operable control member so as to permit decreased airflow through said duct when said first user-operable control member is adjusted to call for a lower temperature to be maintained in said freezer compartment and to permit increased airflow through said duct when said first user-operable control member is adjusted to call for a higher temperature to be maintained in said freezer compartment; and said second movable air restricting member is operatively connected to said second user-operable control member for ganged operation with said thermostatic control so as to permit increased airflow through said duct when said second user-operable control member is adjusted to call for a lower temperature to be maintained in said fresh food compartment and to permit decreased airflow through said duct when said second user-operable control member is adjusted to call for a higher temperature to be maintained in said fresh food compartment.

8. A refrigerator according to claim 6, wherein said movable air restricting members are dampers.

9. A refrigerator according to claim 6, wherein one of said movable air restricting members is a damper and the other of said movable air restricting members is a plug having an inclined surface.

10. A refrigerator according to claim 6, wherein said movable air restricting members are plugs having facing inclined surfaces.

11. A refrigerator according to claim 6, wherein said movable air restricting members together comprise a needle valve, one of said air restricting members being the seat and the other being the needle.

12. A refrigerator according to claim 6, wherein said movable air restricting members are slotted shutters.

13. A refrigerator according to claim 6, wherein said movable air restricting members are discs having corresponding openings.

14. A refrigerator according to claim 6, wherein said movable air restricting members are coaxial cylinders having corresponding openings.

* * * * *

UNITED STATES PATENT AND TRADEMARK OFFICE

CERTIFICATE OF CORRECTION

PATENT NO. : 4,009,590

DATED : March 1, 1977

INVENTOR(S) : WILLIAM M. WEBB and WILLIAM F. HESTER

It is certified that error appears in the above-identified patent and that said Letters Patent are hereby corrected as shown below:

Column 2, line 12, "decreases" should read -- increases --.

Column 4, line 63, "decreases" should read -- increases --.

Column 17, line 4, "useroperable" should read -- user-operable --.

Column 18, line 21, after "said" insert -- first --.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*